US005992366A

United States Patent [19]

Krueger

[11] Patent Number: 5,992,366

[45] Date of Patent: Nov. 30, 1999

[54] IGNITION SWITCH CUTOUT MODULE

[75] Inventor: Dale R. Krueger, Crystal Lake, Ill.

[73] Assignee: Questek Manufacturing Corporation, Elgin, Ill.

[21] Appl. No.: 09/062,696

[22] Filed: Apr. 20, 1998

[51] Int. Cl.[6] ..... F02N 11/08

[52] U.S. Cl. ..... 123/179.3

[58] Field of Search ..... 123/179.3; 337/333; 307/10.6; 290/38 R; 70/255

[56] References Cited

U.S. PATENT DOCUMENTS

| | | | |
|---|---|---|---|
| 3,387,598 | 6/1968 | Almenfors et al. | 123/41.15 |
| 4,389,692 | 6/1983 | Sabder et al. | 361/29 |
| 4,674,344 | 6/1987 | Kazino et al. | 74/7 A |
| 5,239,954 | 8/1993 | Boegner et al. | 123/179.3 |

*Primary Examiner*—Tony M. Argenbright
*Assistant Examiner*—Arnold Castro
*Attorney, Agent, or Firm*—Dorn, McEachran, Jambor & Keating

[57] ABSTRACT

A thermal cutout module is insertable into the starting circuit of a vehicle. The module places a thermal cutout in intimate physical contact with the ignition switch. In the event of a failure in the ignition switch creating an overheating condition the thermal cutout will open and stop current from flowing in the starting circuit. The module includes a control relay which allows the starting current to flow through the relay and not through the ignition switch contacts. LED's are provided to indicate the status of the cutout module. A portion of the module is mounted on a bracket attached to the vehicle firewall.

12 Claims, 5 Drawing Sheets

IGNITION SWITCH CUTOUT MODULE

BACKGROUND OF THE INVENTION

This invention relates to a cutout module for a vehicle starting circuit. It is applicable to any vehicle ignition system but is particularly useful in vehicles having a heavy duty cycle for the ignition switch. Service and delivery vehicles are likely to have such a heavy duty cycle because the vehicles are started and stopped so frequently. A particular example of this is the long life vehicle (LLV) used by the United States Postal Service.

The LLV has an ignition switch with a contact rating of 35,000 cycles. The amperage rating is approximately 30 amps. The switch design consists of spring contact terminals and a drag plunger spring resistor. Due to the extreme duty cycle of the LLV (some starting up to 250 times a day) the ignition switch may reach its designed cycle threshold in under one year. Accordingly, these vehicles have been subject to ignition switch failures, apparently due to mechanical wear of the ramps and/or contact bars within the switches. Switch failure can cause carbonized shorting within the switch. It is believed that such shorting has been the cause of several vehicle fires.

One way to address the problem of ignition switch failures is to replace the switches as part of routine maintenance. But this approach has proven to be extremely costly. Another problem with routine replacement of the ignition switches is that studies to date have not been able to positively identify the exact failure mode or the predicted time at which a switch can be expected to fail. Thus, replacing ignition switches on a routine basis may result in replacement of switches that have significant remaining life. Conversely, some switches may fail and cause fires well before their rated life cycle expires.

SUMMARY OF THE INVENTION

The present invention concerns an ignition switch cutout module. The module is designed to sense the high temperature and amperage draw associated with a shorting condition and interrupt current flow through the vehicle ignition switch and starter circuit. The cutout module will obviate the need to replace ignition switches as a preventive measure to protect vehicles from a shorting or fire hazard. Replacement of the ignition switch and the module of the present invention will only be required if the module senses a failure condition and interrupts current to the ignition switch.

The cutout module of the present invention is designed as an add-on component that will not require complicated installation procedures such as splicing into existing wiring. Instead, the cutout module has two housings electrically connected to one another. Each housing has a plug-in type connector for mating with connectors already existing in the vehicle. A first housing plugs into the connector on the vehicle ignition switch. This housing contains a thermal cutout in intimate thermal contact with the starter terminal of the ignition switch. If an over temperature condition is detected, the thermal cutout will open and interrupt current flow through the starter circuit.

The second housing has a connector which allows it to join a mating connector already existing in the wiring harness. Thus, the existing wiring harness plugs into the second housing of the cutout module and the first housing of the cutout module plugs into the ignition switch. The second housing contains a control relay which routes current for the starter circuit through the relay contacts rather than through the ignition switch contacts. The second housing also contains fuses which monitor current to the ignition switch and interrupt that current should it exceed the ratings of the fuses. LEDs are provided in the second housing to indicate the source of a problem should one occur. The second housing is mounted near the first housing on a bracket fastened to the vehicle's firewall.

When the module interrupts the starting circuit through an over temperature or an over current condition, the module will have to be replaced. However, the LEDs provided will permit the mechanics to analyze the vehicle to determine the defect responsible for the over temperature or over current condition. These functions address what are perceived to be the most likely mechanisms for ignition switch fires.

DETAILED DESCRIPTION OF THE INVENTION

Figure 1:
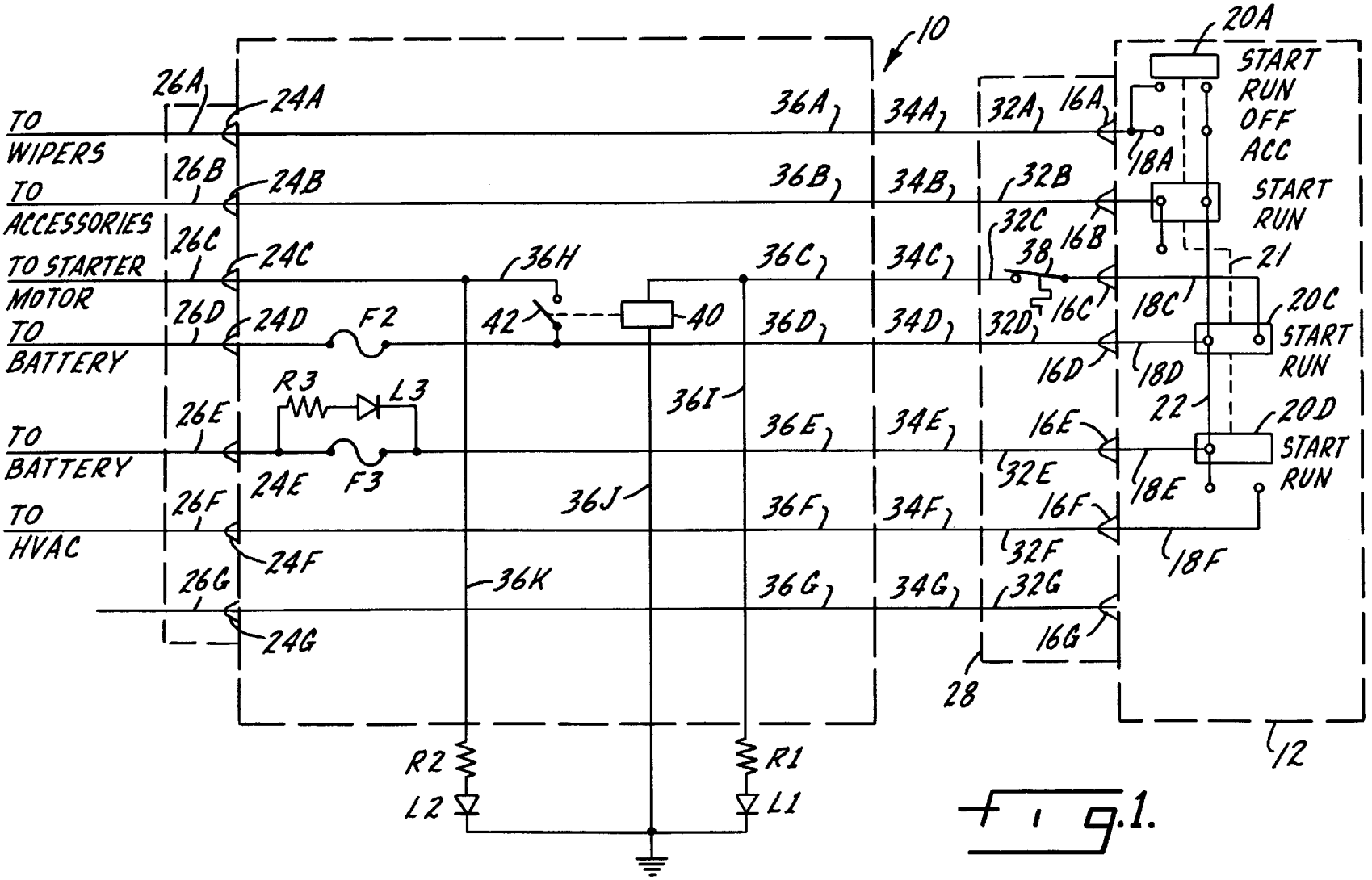
FIG. 1 shows a schematic diagram of the switch cutout module according to the present invention.

FIG. 1 illustrates the electrical circuit of the ignition switch cutout module of the present invention, and also gives a schematic representation of the mechanical aspects of the invention. In the following description individual like parts are denoted with a common reference number and individual letter while the like parts collectively will be referred to by the common reference number only. Associated parts forming part of the same circuit element will be referred to by their common letter, e.g., circuit line A includes connectors and conductors 16A, 18A, 32A, 34A, 36A etc.

The cutout module shown generally at 10 interfaces with existing portions of the vehicle electrical system. These existing portions include an ignition switch 12 and a plug-in connector 14 at the end of a wiring harness. Prior to introduction of the cutout module 10, the connector 14 was plugged into the ignition switch 12 at a mating connector on the switch. In accordance with the present invention, the connector 14 is unplugged from switch 12 and the cutout module 10 is inserted between the switch and connector.

The housing of the ignition switch is shown schematically at 12. A plurality of male terminals 16A–16G extend from the housing 12 for connection to external elements. The terminals 16 are connected internally to conductors as 18A–18F as shown. The conductors 18 are alternately opened or closed by sliding contacts 20A–20D. These contacts 20 are ganged together as schematically indicated by dashed line 21. Each of the contacts is slidably engageable with a bus 22 which normally is connected to the positive terminal of the vehicle battery through conductors described below. The contacts 20 move when the vehicle operator turns the key in the ignition switch. The vehicle operator can move the switch among positions designated accessory, lock, off, run, bulb test and start. Only the start and run positions are designated for contacts 20B–20D. Contact 20A additionally illustrates the off and accessory positions. It will be understood that the complete circuit for the ignition switch is not shown since certain aspects of it are not relevant to the present invention.

The other pre-existing element of the vehicle electrical system is the wiring harness connector illustrated schematically at 14. In actual U.S. Postal Service long life vehicles, this block comprises blue and black housings having female terminals 24A–24G incorporated therein. As mentioned above, prior to implementation of the present invention, terminals 24 would mate with terminals 16 on ignition switch 12. In the present invention, the terminals 16 and 24 are separated and the ignition switch cutout module 10 is inserted between them. The terminals 24A–24G of connector 14 have corresponding conductors 26A–26G attached thereto. Conductors 26 lead to other electrical system components in the vehicle. For example, conductor 26A leads to the vehicle's windshield wiper fuses. Conductor 26B connects to the fuse block for accessories such as the fan, turn signals or backup lights. Conductor 26C connects to the starter relay (if one is installed) or starter solenoid, which in turn supplies power to the starter motor. Conductors 26D and 26E are both connected to the positive side of the vehicle battery. Conductor 26F connects to the HVAC fuses while 26G may be used for other accessories such as the panel dimmer switch.

Turning now to the cutout module 10 of the present invention, it includes a first housing, a second housing and a cable connecting the first and second housings. The first and second housings are indicated schematically at 28 and 30, respectively. The cable between the first and second housings may be fitted with appropriate connectors at either end for plugging into the housings or the cable may be hard wired into the housings 28 and 30. The first housing plugs onto the ignition switch 12. It is important that the first housing 28 be in intimate physical contact with the ignition switch 12 for purposes of transferring heat, as will be further explained below. The first housing 28 has female terminals which plug onto the terminals 16 of the ignition switch 12. Within housing 28 there are conductors 32A–32G, each associated with one of the female terminals on the housing. Conductors 32 are further connected to conductors 34A–34G that comprise the cable between the first and second housings.

Figure 2:
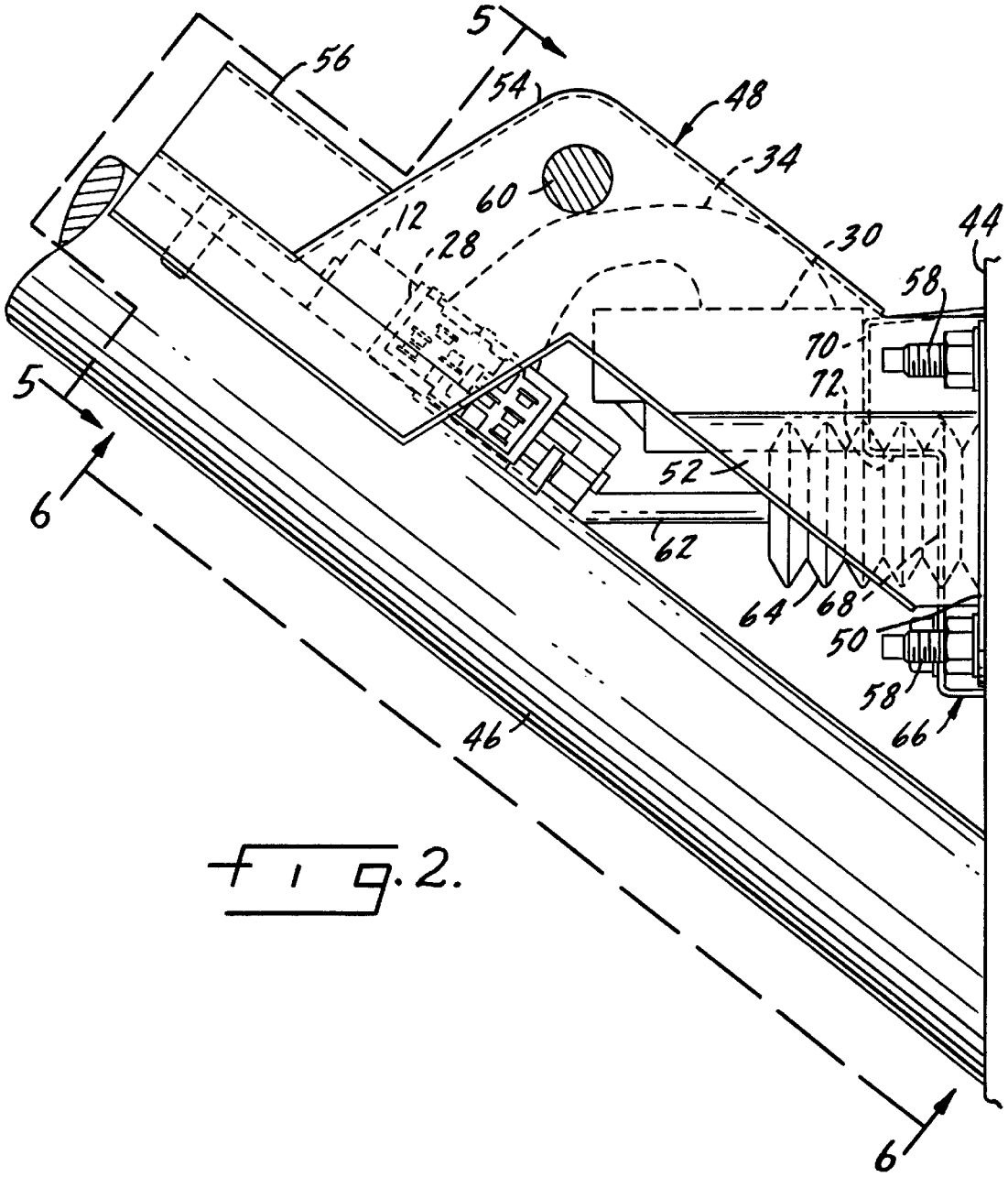
FIG. 2 is a side elevation view of the under dash components of an LLV, looking from the right door side toward the interior of the LLV, which is a right-hand drive vehicle.
Figure 3:
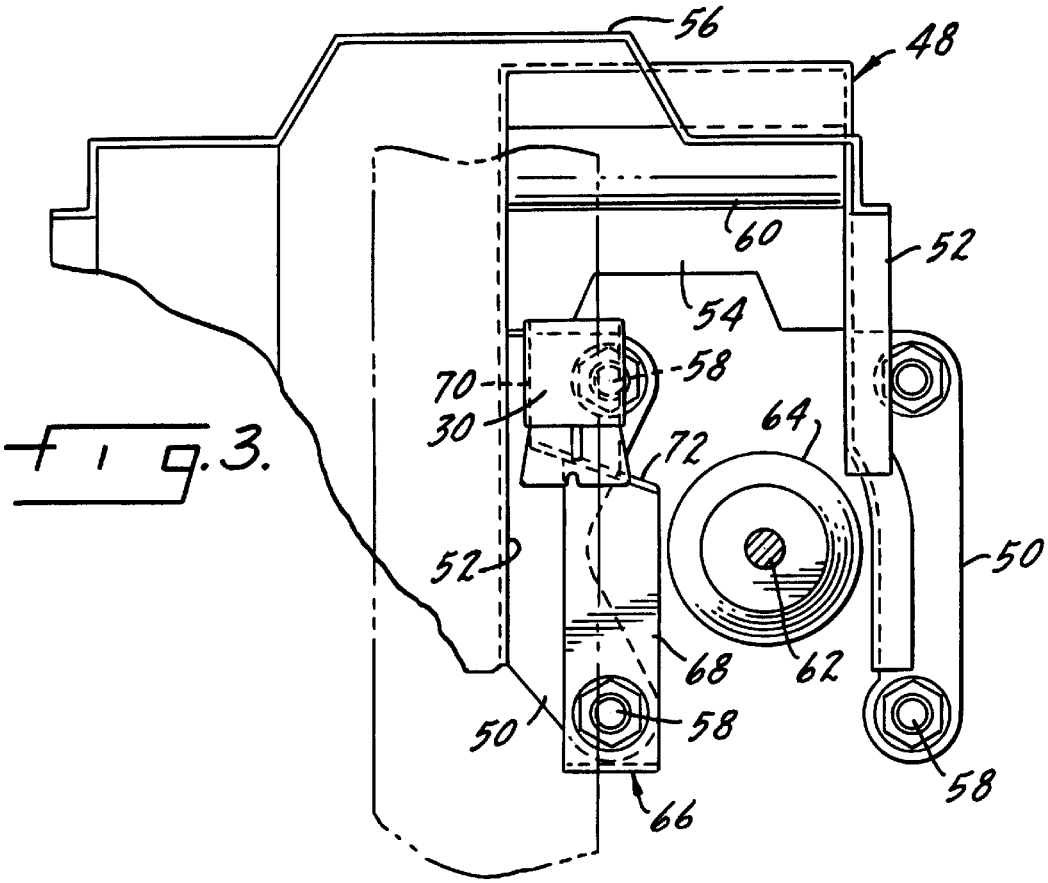
FIG. 3 is a front elevation view of the under dash components of an LLV, looking from the driver's seat toward the firewall.
Figure 5:
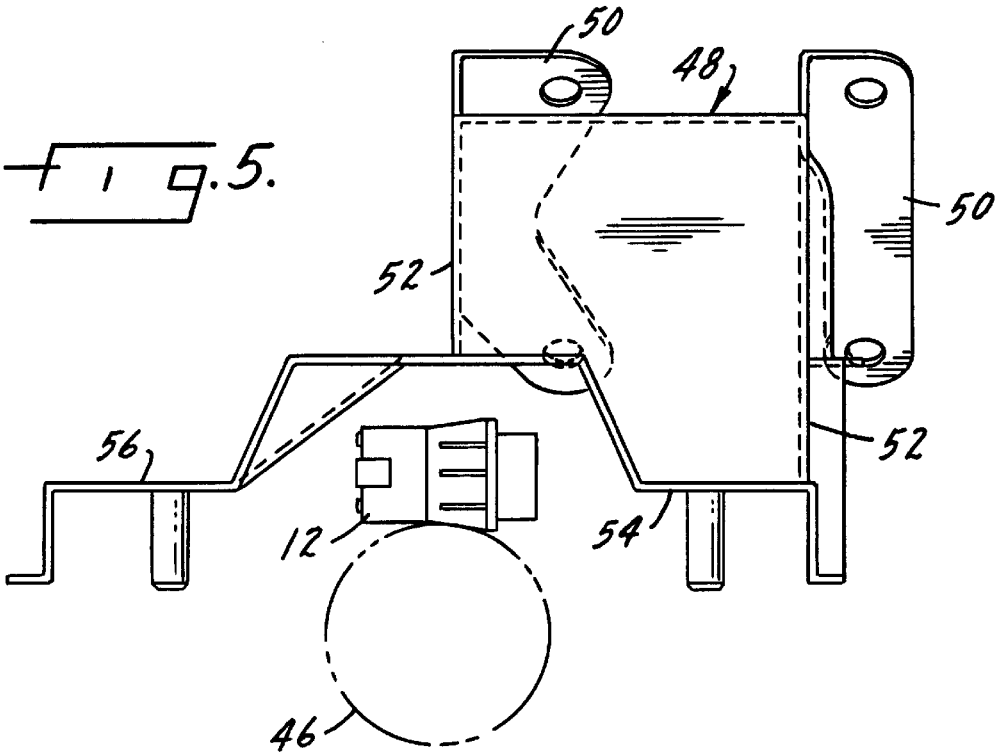
FIG. 5 is a view taken along line 5—5 of FIG. 2, looking straight down the steering column.
Figure 4:
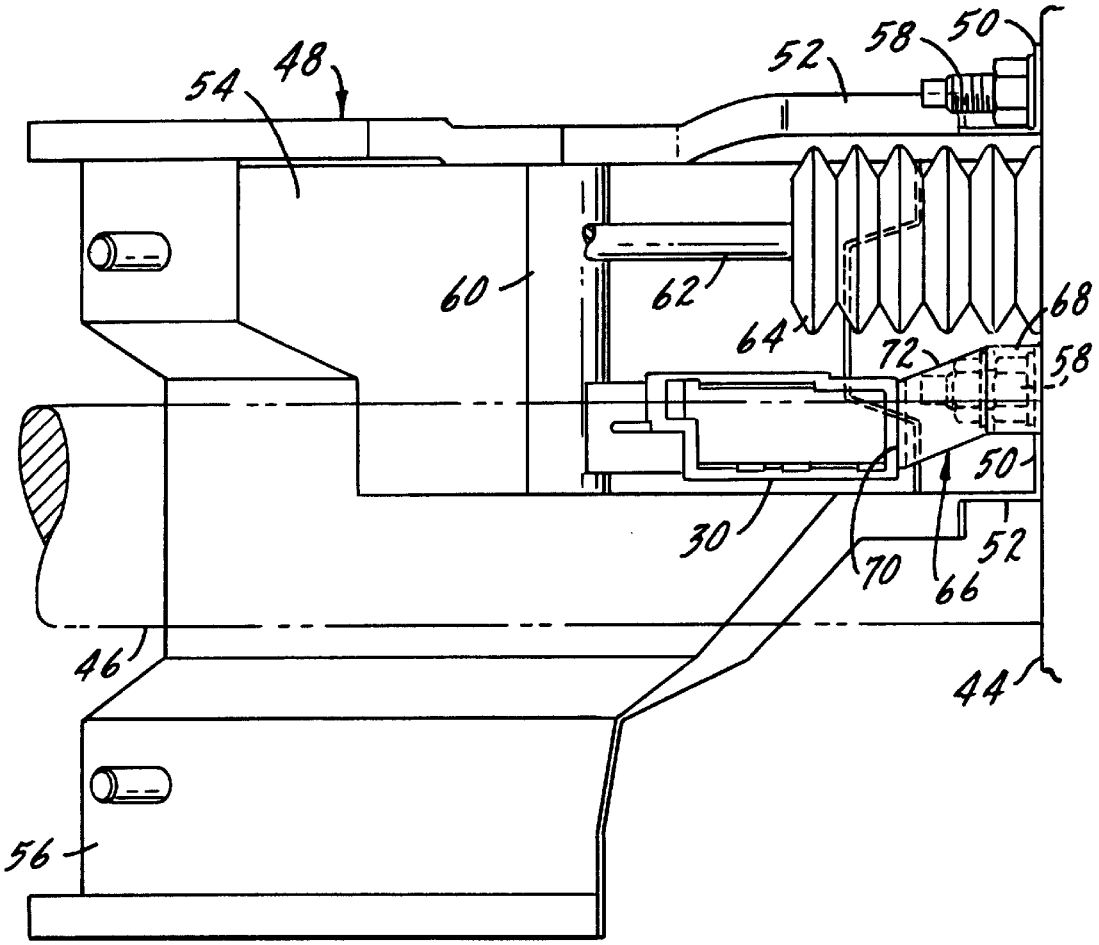
FIG. 4 is a bottom plan view of the under dash components of an LLV, looking up from the floorboard.
Figure 6:
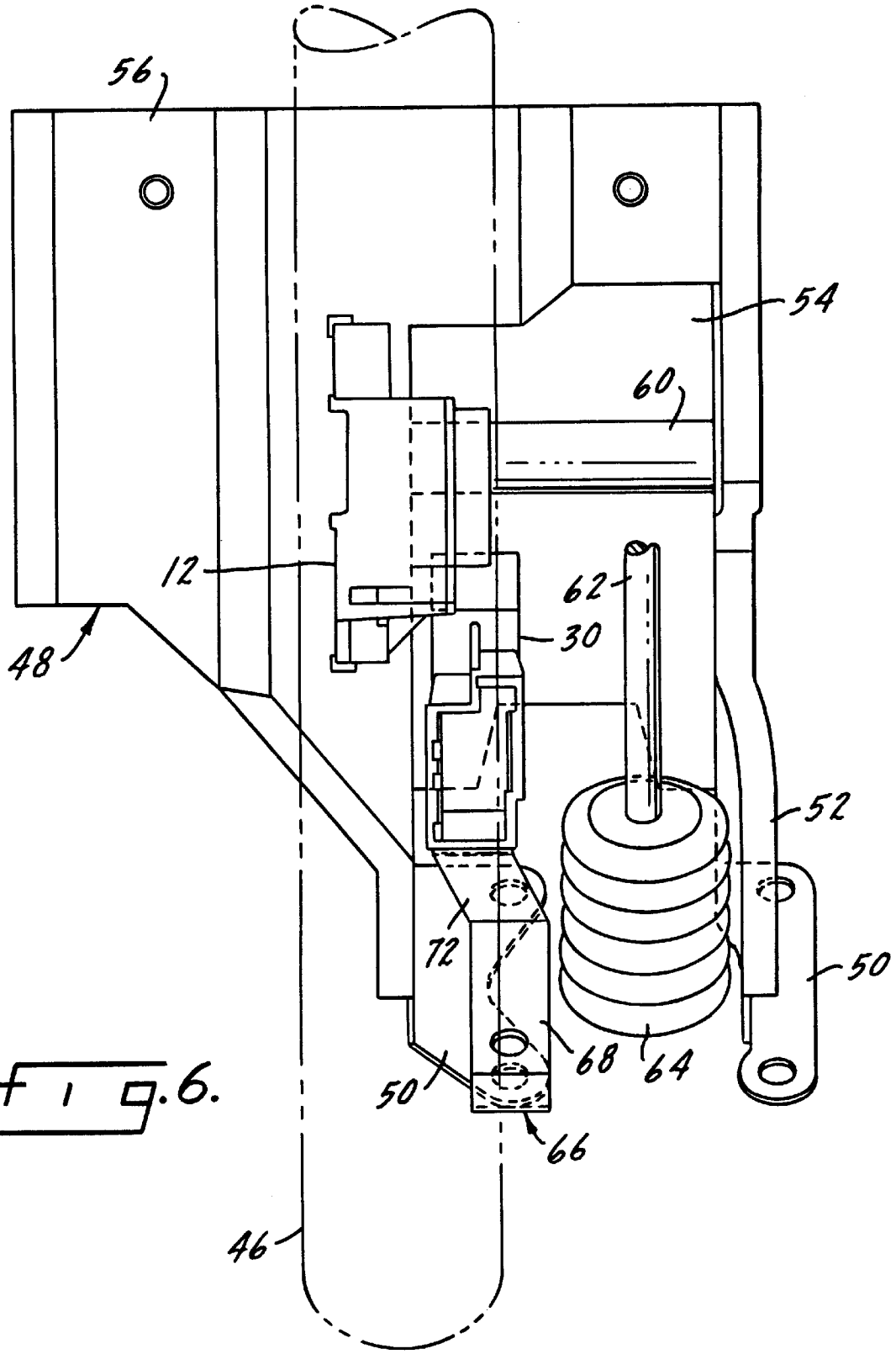
FIG. 6 is a view taken along line 6—6 of FIG. 2, looking perpendicularly to the axis of the steering column.

The second housing 30 is suitably mounted somewhere on the vehicle dash, firewall or floor. In the U.S. Postal Service long life vehicle there is a bolt in the firewall to which a metal bracket may conveniently be added. The bracket then supports the second housing 30 and provides a suitable ground. Details of the bracket are shown in FIGS. 2–4 below. As mentioned above, the terminals 26 of connector 14 of the existing wiring harness plug onto male terminals which are mounted in the second housing 30. The second housing further includes conductors 36A–36K. Conductors 36A–36G generally connect the cable conductors 34A–34G to terminals 24 (with the exception of 36C, which is discontinuous as shown, conductor 36H providing the connection to terminal 24C).

The bus 22 in the ignition switch 12 is connected to the vehicle battery as shown through the circuit lines D and E. Conductors 18A, 18B, 18C and 18F are connectable to the voltage on the bus 22 by means of the contacts 20A–20D. The contacts are shown in FIG. 1 in the start position. In this position, contact 20C places the battery voltage on conductor 18C of the ignition switch. Located in conductor 32C is a thermal cutout 38. The thermal cutout is a wax plug that holds two pieces of metal together. When the plug is heated above its melting point the wax melts and opens the circuit. The thermal cutout 38 is in intimate thermal contact with the connector 16C of the ignition switch. By way of example, the thermal cutout is chosen to open at about 90–95 degrees C., which is about 10 degrees C less than the temperature rating of the insulation on the under dash wiring. The thermal cutout is, of course, normally closed.

Inside the second housing 30, the conductor 36C connects to a control relay having a coil 40 and normally open contacts 42. Conductor 36J grounds the coil 40. The contacts 42 when closed join conductor 36D to conductor 36H. As indicated at the left hand side of FIG. 1, conductor 36H leads to the vehicle starter motor. Conductor 36I includes a resistor R1 and an LED L1. Similarly, conductor 36K includes a resistor R2 and an LED L2. Both LEDs are connected to ground as shown. Preferably the resistors R1 and R2 are about 1000 ohms each.

Conductor 36E in the second housing includes a fuse F3 and a surrounding resistor R3 and LED L3. R3 is something on the order of 1000 ohms while the resistance of the relay coil 40 is about 70 ohms. Conductor 36D contains a fuse F2. F2 and F3 are standard automotive fuses. They could also be copper traces on a PC board. Conductors 36D and 36E are both connected to the vehicle battery positive terminal as shown at the left side of FIG. 1.

FIGS. 2–6 illustrate one possible arrangement for mounting the cutout module in a long life vehicle (LLV) used by the United States Postal Service. As is evident from the drawings, the geometry under the dash is complex and presents great difficulty in finding a location for the cutout module that meets the following criteria: the module must be as close as possible to the ignition switch; the module must connect to the existing wiring harness that is routed to the ignition switch; the cable between the first and second housings must not interfere with the steering column or with brake pedal action; the module must be tucked out of the way of the driver's feet; the module must be installable and its LED's must be visible without disassembling anything; the mounting should provide access to a sound chassis ground to eliminate a wire and separate electrical ground connection; the mounting should provide a rigid, repeatable means of installation so every installation is the same, free from variations resulting from different mechanics installing the modules.

Looking now at FIG. 2, the vehicle firewall is shown schematically at 44. Extending diagonally from the firewall 44 is a steering column 46. The ignition switch 12 is mounted on the steering column 46 and the first housing 28 is attached to the ignition switch 12 as described above. The steering column is supported by a rather large, complex steering and brake bracket shown generally 48. Bracket 48 includes a pair of feet 50 each mounting a side wall 52 which in turn support a shroud portion 54 and an extension 56. The feet 50 lie flush against the firewall where they are retained by four bolts 58. A brake pedal pivot shaft 60 is mounted by the side walls 52 of bracket 48. The actual brake pedal is not shown but it is connected to the pivot shaft 60 and the brake actuator plunger 62, which extends through the firewall. The plunger 62 is surrounded by a bellows or boot 64.

The cutout module's second housing 30 is mounted a module bracket 66. Bracket 66 rests on one of the feet 50 and is held in place by one of the bolts 58, as best seen in FIG. 2. The bracket 66 has a first and second sections 68 and 70, joined by a transition section 72. As seen in FIG. 3, the transition section provides an offset or jog in the module bracket 66 that improves alignment of the second section 70 with the ignition switch 12. The second housing 30 is fastened to the second section 70 of bracket 66.

The use, operation and function of the invention are as follows. When the vehicle operator places the ignition switch contacts 20 in the start position as shown in FIG. 1, the battery voltage is supplied through circuit lines D and E, including fuses F2 and F3, to the bus 22. Contact 20C applies the voltage to circuit line C, including the thermal cutout 38 and the control relay. This energizes coil 40 which in turn closes contacts 42, completing a circuit through F2 to conductor 36H which then energizes the starter motor, either through a second relay and starter solenoid or through a starter solenoid alone. Thus, in the normal circumstance, the starter current flows through relay contacts 42 and not through the ignition switch contacts 20.

In the event of a failure of the ignition switch resulting in prolonged connection of bus 22 to conductor 18C, the ignition switch will heat up and that heat will be transferred to the first housing 28 and thermal cutout 38. If sufficient heat is generated, the cutout 38 will open and thereby deenergize coil 40. This in turn will open contacts 42 and remove the starter current from the starter motor.

The LEDs L1, L2 and L3 give an indication of the status of the cutout module. The following truth table shows the status of the LEDs under varying conditions of the thermal cutout 38 and the fuses F2 and F3. In this table, a 0 indicates an open circuit and a 1 indicates a closed circuit.

| | | | | | | | | |
|---|---|---|---|---|---|---|---|---|
| Cutout 38 | 0 | 0 | 0 | 0 | 1 | 1 | 1 | 1 |
| Fuse F2 | 0 | 1 | 0 | 1 | 1 | 0 | 1 | 0 |
| Fuse F3 | 0 | 1 | 1 | 0 | 1 | 1 | 0 | 0 |
| LED L1 | off | off | off | off | ON | ON | ON | off |
| LED L2 | off | off | off | off | ON | ON | ON | off |
| LED L3 | ON | off | off | off | off | off | off | ON |

It is pointed out that L3 is ON in the condition of an open thermal cutout and open fuses F2 and F3 due to a path to ground through the circuit line E, bus 22 and circuit line B. Also, L3 is off when F3 is open and F2 is closed due the right hand side of circuit line E having the same voltage as the left hand side because of the voltage supplied through circuit line D and bus 22.

One of the advantages of the present invention is that it does not require any alteration to the existing wiring. The connector 14 is simply unplugged from the ignition switch 12 and the first and second housings 28 and 30 are placed intermediate the connector and ignition switch. The housings each have plug-in connections with an adjoining cable. Thus, no splicing or connection of individual wires is required. The invention also provides a convenient way to add a control relay to starting circuits that are not already equipped with one. As mentioned above, inclusion of a control relay in the starting circuit has the advantage of removing the relatively high starting current from the ignition switch contacts. Another advantage of the invention is the inclusion of fuses F2 and F3. In existing circuits lines D and E are 10 gauge wires with a fusible link in the circuit between the battery and the ignition switch. This fusible link carries current that is eventually branched into eight circuits before it reaches the fuse block. The fuses F2 and F3 of the present invention will provide a faster response than the fusible link to protect the wiring on the load side of the ignition switch.

While a preferred form of the invention has been shown and described, it will be realized that alterations and modifications may be made thereto without departing from the scope of the following claims.

I claim:

1. In a vehicle starting circuit of the type having a starter motor, a battery, and an ignition switch electrically connected in circuit with the starter motor and battery, the ignition switch being actuatable by the vehicle operator to selectively supply electric power from the battery to the starter motor, the improvement comprising an ignition switch cutout module, comprising a thermal cutout electrically connected to the ignition switch and mounted in heat transferring relation with the ignition switch such that overheating of the ignition switch will cause the thermal cutout to open the vehicle starting circuit.

2. The ignition switch cutout module of claim 1 further comprising a relay having a coil in series with the thermal cutout and contacts in series with the battery and the starter motor such that current for the starter motor is routed through the relay contacts rather than through the ignition switch.

3. The ignition switch cutout module of claim 2 further comprising a fuse electrically connected between the battery and thermal cutout.

4. The ignition switch cutout module of claim 2 further comprising indicator means in parallel with the relay coil.

5. The ignition switch cutout module of claim 2 further comprising indicator means in series with the relay contacts.

6. The ignition switch cutout module of claim 1 wherein the ignition switch includes plug-in connectors and wherein the ignition switch cutout module further comprises a first housing containing the thermal cutout and having a plug-in connector mating with the plug-in-connector of the ignition switch.

7. The ignition switch cutout module of claim 6 wherein the ignition switch cutout module further comprises a second housing electrically connected to the first housing and containing a relay having a coil in series with the thermal cutout and contacts in series with the battery and starter motor such that current for the starter motor is routed through the relay contacts rather than through the ignition switch.

8. The ignition switch cutout module of claim 1 wherein the vehicle starting circuit further comprises a starter solenoid between the battery and starter motor.

9. The ignition switch cutout module of claim 8 wherein the vehicle starting circuit further comprises a starter relay between the battery and starter solenoid.

10. In a vehicle of the type having a chassis including a steering column and a firewall, and a starting circuit including an ignition switch mounted on the steering column, the improvement comprising an ignition switch cutout module including first and second housings electrically connected by a cable, the first housing having a thermal cutout therein electrically connected to the ignition switch and mounted in heat transferring relation with the ignition switch such that overheating of the ignition switch will cause the thermal cutout to open the vehicle starting circuit, the second housing being mounted on a bracket fastened to the vehicle firewall.

11. The ignition switch cutout module of claim 10 wherein the bracket is configured to place the second housing proximate to the first housing.

12. The ignition switch cutout module of claim 10 wherein the bracket provides an electrical ground to the vehicle chassis.

* * * * *